US006464423B1

(12) United States Patent
Klein

(10) Patent No.: US 6,464,423 B1
(45) Date of Patent: Oct. 15, 2002

(54) GANGING BRACKET

(75) Inventor: Mark P. Klein, Chicago, IL (US)

(73) Assignee: Bretford Manufacturing, Inc., Franklin Park, IL (US)

( * ) Notice: Subject to any disclaimer, the term of this patent is extended or adjusted under 35 U.S.C. 154(b) by 0 days.

(21) Appl. No.: 09/256,252

(22) Filed: Feb. 23, 1999

(51) Int. Cl.[7] ..... E05C 3/04

(52) U.S. Cl. ..... 403/322.4; 403/DIG. 9; 292/101; 292/202

(58) Field of Search ..... 403/322.4, 321, 403/384, DIG. 9; 108/64, 65, 69, 90; 292/252, 102, 103, 101, 203, 204, 202; 411/546, 180

(56) References Cited

U.S. PATENT DOCUMENTS

| | | | | | |
|---|---|---|---|---|---|
| 296,402 | A | * | 4/1884 | Goforth | 292/101 |
| 621,318 | A | * | 3/1899 | Brachhausen | 292/101 |
| 1,513,234 | A | * | 10/1924 | Fritsch | 292/101 |
| 1,742,764 | A | * | 1/1930 | Giltsch et al. | 292/103 |
| 1,772,177 | A | * | 8/1930 | Dake | 292/202 |
| 1,800,172 | A | | 4/1931 | Walter | |
| 1,926,949 | A | * | 9/1933 | Kennedy | 285/374 X |
| 1,943,927 | A | * | 1/1934 | Phillips | 292/101 X |
| 2,544,611 | A | * | 3/1951 | Nottingham | 292/202 X |
| 2,714,751 | A | | 8/1955 | Stuart et al. | |
| 2,853,752 | A | | 9/1958 | Schlueter | |
| 3,820,477 | A | | 6/1974 | Griffin | |
| 3,915,100 | A | | 10/1975 | Sullivan | |
| 3,966,245 | A | * | 6/1976 | Losenno | 292/202 |
| 5,182,996 | A | | 2/1993 | Gutgsell | |
| 5,456,505 | A | * | 10/1995 | Yamada | 292/202 |
| 5,468,109 | A | * | 11/1995 | Ferrari et al. | 411/180 |
| 5,577,854 | A | * | 11/1996 | Jacob et al. | 411/546 |
| 5,678,948 | A | | 10/1997 | White | |

* cited by examiner

*Primary Examiner*—Lynne H. Browne
*Assistant Examiner*—David E. Bochna
(74) *Attorney, Agent, or Firm*—Welsh & Katz, Ltd.

(57) ABSTRACT

Improved table connecting brackets capable of quickly and easily connecting and disconnecting tables. The ganging bracket comprises a mounting assembly that can be attached to the first table and a connector assembly that can be attached to the second table. The ganging bracket also comprises a swing arm that has at least one seat disposed at one end of the swing arm and is constructed to receive and lock to the connector assembly. A tooth is disposed on the swing arm proximate each seat. The swing arm also has an aperture that is disposed on the swing arm distal the at least one seat, is constructed to receive the mounting assembly and is positioned and configured to allow the swing arm to be rotatably mounted to the first table.

15 Claims, 3 Drawing Sheets

GANGING BRACKET

FIELD OF THE INVENTION

The present invention relates to ganging brackets, and more particularly to ganging brackets that duly provide for quickly and easily connecting and disconnecting tables together and provide for enhanced stability and retention of the connected tables.

BACKGROUND OF THE INVENTION

Tables of various shapes are used in diverse applications and arrangements. Frequently tables are arranged adjacent and abutting one another. Since tables may be inadvertently moved in such groupings, it is desirable to be able to interconnect and lock in place abutting tables for increased stability. Also, to provide for arrangements where a table is not connected to another table, a table connecting device that retracts out of the way underneath the table is advantageous to prevent the device from projecting out from under the table top. Table connecting devices of various types are well known in the art. Such devices are used for connecting and securing two or more tables together in the desired configuration. These devices are commonly used in a commercial setting such as conference rooms, but may also be used in a residential setting. The prior art, however, has inherent disadvantages.

One of the disadvantages of the prior art is that existing table connecting devices are designed so as to require that the connecting devices be mounted at a specific distance from the table's edge for the bracket to align properly with whatever device it is connecting to on the adjoining table. Since tables are commonly manufactured whereby the table core is formed first and then the desired edging which is available in different horizontal thicknesses is then fastened to the core, existing table connecting devices necessitate that the mounting holes in the core must be located at varying distances from the edge of the core due to the different table edge thicknesses. As a result, most table designers and manufacturers are required to design several different locations for mounting the brackets to the core and are required to maintain an inventory of many different types of table connecting devices. This generally substantially increases engineering design costs, requires many different design drawings, increases manufacturing costs, such as tooling, increases inventory volume because multiple connecting devices are required, and creates potential manufacturing and packaging difficulties.

Another disadvantage of the prior art is that many of the connecting devices require the user to tighten a screw or bolt to connect and lock the adjoining tables in place. This requires considerable time and effort for the user especially where the tables are reconfigured several times a day to satisfy different requirements of the room. Also, over time, the screw or bolt threads can become dirty or worn and the connecting device will not function properly.

The present invention overcomes these and other problems inherent in existing table connecting devices. The present invention provides a table connecting and locking bracket that operates quickly and easily to connect and disconnect two tables without adjustment of hardware. The ganging bracket joins tables side to side or back to back. Further, the ganging bracket eliminates the need for different mounting designs to accommodate different edge thickness, thus eliminating the need for many different engineering drawings detailing the different mounting locations on the table core for different edge thicknesses. Also, the user does not need any additional tools to quickly and easily connect the tables together with the ganging bracket. A feature of the bracket is that the swing arm of the bracket has multiple mounting seats that may be connected to a grommet on an adjoining table simply by rotating the swing arm and press locking the appropriate seat around the grommet fixed to the adjoining table. The horizontal thickness of the edging attached to the table core will dictate which seat will align with the grommet on the adjoining table. Therefore, the bracket may always be mounted the same distance from the edge of the table core. This universality is distinguished from the conventional connecting device which must be mounted on the table at a distance from the table edge that varies depending on the edge thickness. The ganging brackets will typically be used on tables located in rooms that require frequent table reconfiguration.

OBJECTS OF THE INVENTION

The principal object of the present invention is to provide a ganging bracket that can be mounted on the underside of a table for connecting and aligning tables.

Another object of the present invention is to provide a ganging bracket that comprises a swing arm which is a one piece construction.

A further object of the invention is to provide a ganging bracket that can be mounted at a set distance from the table core edge independent of the table edge thickness.

A further object of the invention is to provide a ganging bracket that will provide for enhanced retention of the tables once the tables are connected by the bracket.

A further object of the invention is to provide a ganging bracket which is simple in design and inexpensive to construct, is durable and rugged in structure and is reliable in nature.

A further object of the invention is to provide a ganging bracket that is easy to secure to a mounting surface and is easily operated to facilitate rapid connecting, locking and securing of the tables together without the need to adjust hardware.

A further object of the invention is to provide a low profile table connecting ganging bracket which extends a minimum distance from the underside surface of the table and can retract completely under the table when not in use.

A further object of the invention is to provide a ganging bracket having an attractive appearance.

Still further objects and advantages will become apparent from a consideration of the ensuing description and drawings of the invention.

SUMMARY OF THE INVENTION

These and other objects are achieved by a ganging bracket of the present invention. In one form of the invention, the ganging bracket has three seats that are designed to engage and lock around a grommet. The ganging bracket is rotatably mounted to one table and a swing arm can rotate with respect to a mounting screw and engage a grommet rotatably mounted on the adjacent table. Another feature of the ganging bracket is that after the grommet snaps into the seat, a tooth, disposed on the swing arm adjacent the seat, compresses the grommet and is held in place by the grommet to provide a fit that securely and tightly locks the tables together. Other embodiments of the ganging bracket can have one, two or more seats.

DETAILED DESCRIPTION OF THE PREFERRED EMBODIMENT

Figure 1:
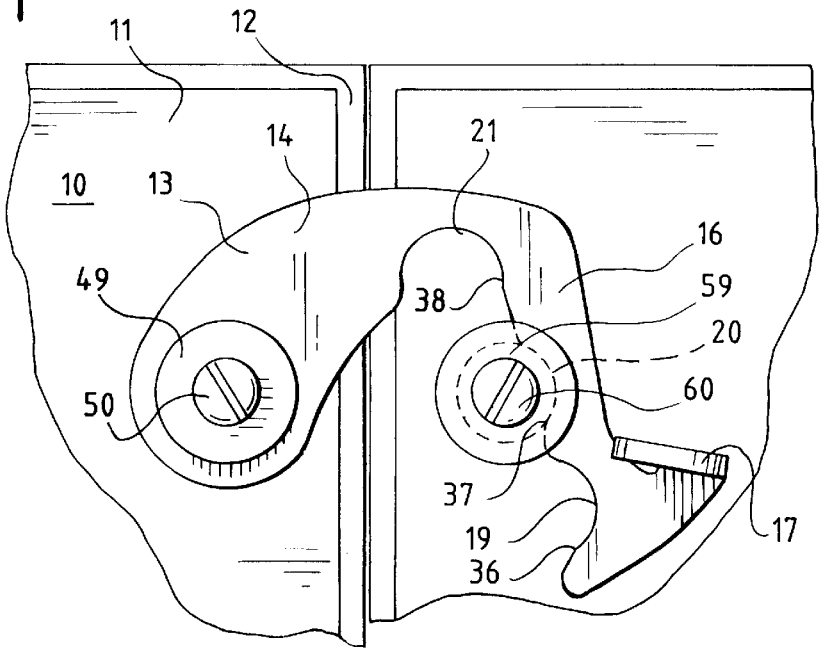
FIG. 1 is a plan view of one embodiment of the ganging bracket of the present invention shown attached to a horizontal mounting surface.
Figure 3:
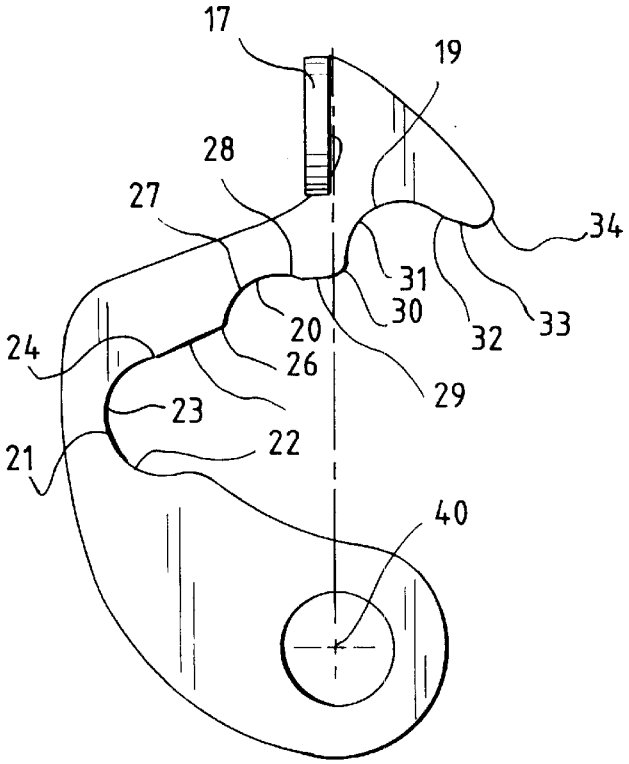
FIG. 3 is a plan view of the swing arm of the ganging bracket of FIG. 1.

FIG. 1 is a plan view of one embodiment of the ganging bracket 10 constructed in accordance with the present invention, shown attached to the underside of a table core 11 proximate a table edge 12. In FIG. 1, the ganging bracket 10 comprises a swing arm 13 that has a body portion 14 and arm 16. The body portion 14 and arm 16 may generally form a V-shaped structure. As best seen in FIG. 3, disposed on the body portion 14 is a hole 40. Turning back to FIG. 1, the swing arm 13 may be constructed of 10 gauge steel, high density plastic or any other suitable material that will provide for proper operation of the ganging bracket 10. Further, the ganging bracket 10 comprises a mounting assembly 49 and a connector assembly 59. Table edge 12 is available in different shapes and is constructed to provide for different horizontal edge thickness.

Attached substantially perpendicular to the arm 16 may be a tab 17 which may be constructed large enough and adapted for a person to easily grasp by hand. Further, disposed on body portion 14 and arm 16 are seats 19, 20, 21 each having a tooth 36, 37, 38, respectively, located adjacent the seats 19, 20, 21 and disposed on the arm 16. The seats 19, 20, 21 may be adapted and sized to receive a rubber grommet 63 (see FIG. 2). Also, the seats 19, 20, 21 may have substantially the same diameter as rubber grommet 63 or may have any other diameter and characteristics necessary for proper operation of the ganging bracket 10.

Figure 2:
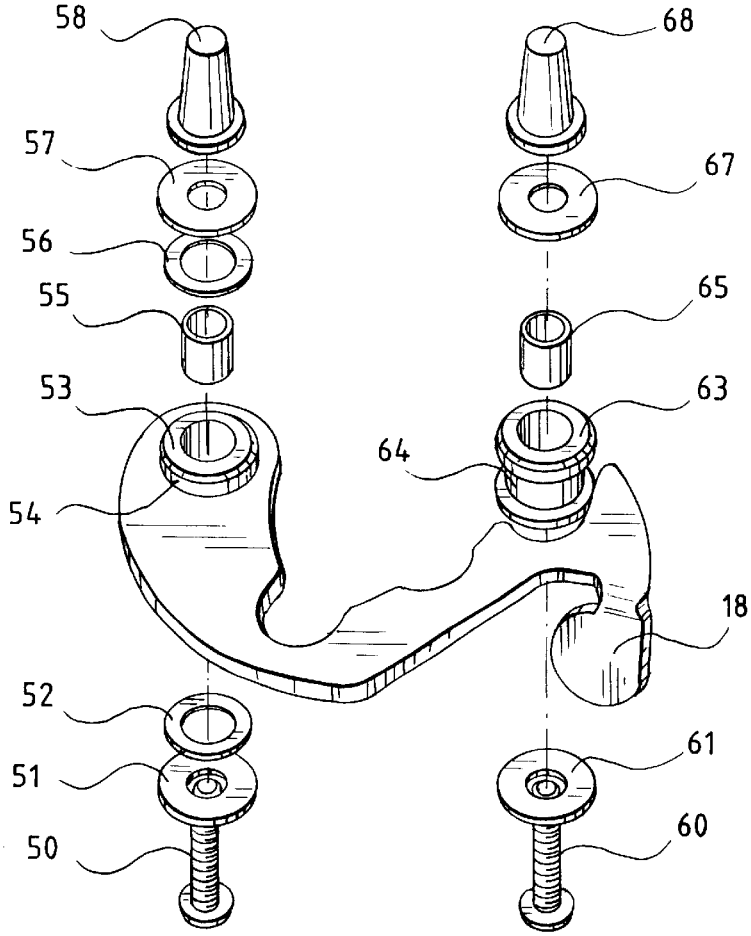
FIG. 2 is a exploded perspective view of the of ganging bracket of FIG. 1.

As shown in FIG. 2, the mounting assembly 49 may comprise a screw 50, a washer 51, a washer 52, a grommet 53, a spacer 55, a washer 56, a washer 57 and an insert 58. The screw 50 may be a 1 3/16", ¼/20 screw coated with a nylon patch such as, for example, ND Patch® as provided by ND Industries of Troy, Mich.; NyLock as provided by Express Fasteners of Glendale Hts., Ill.; or the coating on the screw 50 may be any other type of material that will provide for proper performance of the ganging bracket 10. The coating locks the screw 50 into the insert 58 so the screw 50 cannot loosen when the swing arm 13 rotates about the spacer 55 and the screw 50. Further, the coated screw 50 locks in the spacer 55 between washers 51 and 57 so the spacer 55 is stationary with respect to the swing arm 13 and the grommet 53 when the swing arm 13 rotates about the screw 50. The washers 51 and 57 may be ¼" metal washers and washers 52 and 56 may be Delrin washers. The grommet 53 may be constructed of rubber or any other elastomeric material and have a ⅛" groove 54 that is adapted to fit inside the hole 40. The groove 54 may vary in size depending on the thickness of the swing arm 13 and the specific application of the ganging bracket 10. The spacer 55 may be constructed of nylon. Further, when the spacer 55 is inserted into the grommet 53 the spacer 55 length may be long enough so that the spacer 55 extends past the grommet 53 on each end of the grommet 53. This construction allows the grommet 53 to rotate freely with respect to the spacer 55 and thereby minimizes the rotational forces on the screw 50. The insert 58 may be constructed of metal and inserted into a hole in the mounting surface (i.e., the underside of table core 11), and provides a means for the screw 50 to be inserted into and rotatably mount the ganging bracket 10 to the mounting surface. The screw 50, washer 51, washer 52, grommet 53, spacer 55, washer 56, washer 57 or insert 58 may also have any other characteristics, may be constructed of any other material, or may be any other device that will provide for proper operation of the ganging bracket 10.

Also shown in FIG. 2 is the connector assembly 59 which may comprise a screw 60, a washer 61, a grommet 63, a spacer 65, a washer 67, and an insert 68. The screw 60 may be a 1 3/16", ¼/20 screw coated with a nylon patch such as, for example, ND Patch® as provided by ND Industries of Troy, Mich.; NyLock as provided by Express Fasteners of Glendale Hts., Ill.; or the coating on the screw 60 may be any other type of material that will provide for proper performance of the ganging bracket 10. The coating locks the screw 60 into the insert 68 so the screw 60 cannot loosen when the seat 19, 20 or 21 rotates about and locks around the grommet 63. Further, the coated screw 60 locks in the spacer 65 between washers 61 and 67 so the spacer 65 is stationary with respect to the grommet 63 when the seat 19, 20 or 21 rotates about and locks around the grommet 63. The washers 61 and 67 may be ¼" metal washers. The grommet 63 may be constructed of rubber or any other elastomeric material and may have a ¼" groove that is adapted to allow the seat 19, 20 or 21 to lock around. The groove 64 may be sized larger in length than the thickness of the swing arm 13 to provide the necessary alignment of the seat 19, 20 or 21 with the groove 64 to provide for the instance, for example, where the horizontal centerline of the groove and the horizontal centerline of the swing arm 13 are not aligned (e.g., where the surface that the tables are positioned on is not level). The spacer 65 may be constructed of nylon. Further, when the spacer 65 is inserted into the grommet 63 the spacer 65 length may be long enough so that the spacer extends past the grommet 63 on each end of the grommet 63. This construction allows the grommet 63 to rotate freely with respect to the spacer 65 and thereby minimizes the rotational forces on the screw 60. The insert 68 may be constructed of metal and inserted into a hole in the mounting surface (e.g., the underside of table core 11), and provides a means for the screw 60 to be inserted into and rotatably mount the grommet 63 to the mounting surface. The screw 60, washer 61, grommet 63, spacer 65, washer 67 or insert 68 may also have any other characteristics, may be constructed of any other material, or may be any other device that will provide for proper operation of the ganging bracket 10.

FIG. 3 shows arcs 22 through 34 disposed on the arm 16 and body portion 14. The arcs 22 through 34 are designed to provide proper performance of the ganging bracket 10. The arcs 22 through 34 may have the characteristics and dimensions identified in the following Table A or may have any other characteristics and dimensions necessary for proper operation of the ganging bracket 10.

TABLE A

| ARC | CENTER [Origin (0, 0) is centerline of hole 40] | RADIUS | START | END |
|---|---|---|---|---|
| 22 | −.925, 1.285 | .344" | 224° | 286° |
| 23 | −.948, 1.268 | .315" | 94° | 225° |
| 24 | −.975, 1.629 | .047" | 274° | 301° |
| 25 | 0, 0 | 1.851" | 111° | 121° |
| 26 | −.692, 1.818 | .094" | 291° | 345° |
| 27 | −.296, 1.715 | .315" | 67° | 165° |
| 28 | −.157, 2.049 | .047" | 247° | 274° |

TABLE A-continued

| ARC | CENTER [Origin (0, 0) is centerline of hole 40] | RADIUS | START | END |
|---|---|---|---|---|
| 29 | 0, 0 | 2.008" | 91° | 94° |
| 30 | −.031, 2.102 | .094" | 271° | 0° |
| 31 | .378, 2.100 | .315" | 48° | 180° |
| 32 | .620, 2.369 | .047" | 228° | 255° |
| 33 | 0, 0 | 2.402" | 72° | 75° |
| 34 | .787, 2.369 | .094" | 252° | 36° |

Figure 4:
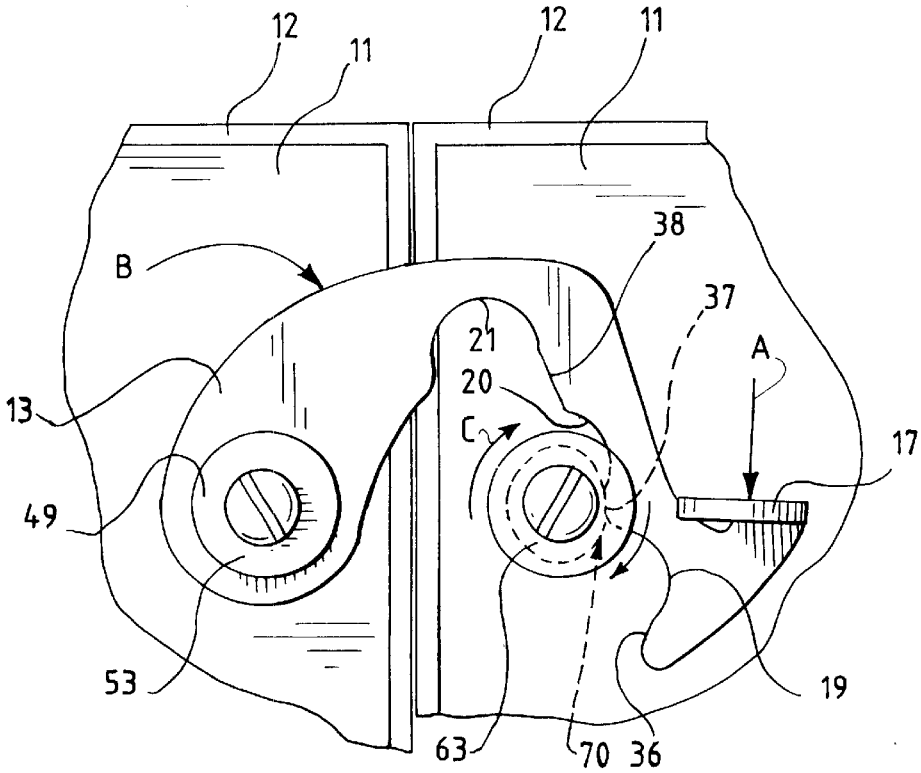
FIG. 4 is a plan view of the ganging bracket of FIG. 1 engaging a grommet.

Further, FIG. 3 shows hole 40 which may have a diameter of .5625 inches, however, the hole 40 should be adapted and sized to receive the grommet 53 and allow the swing arm 13 and grommet 53 to be rotatably mounted with respect to the screw 60 (see FIGS. 1 and 4).

Figure 5:
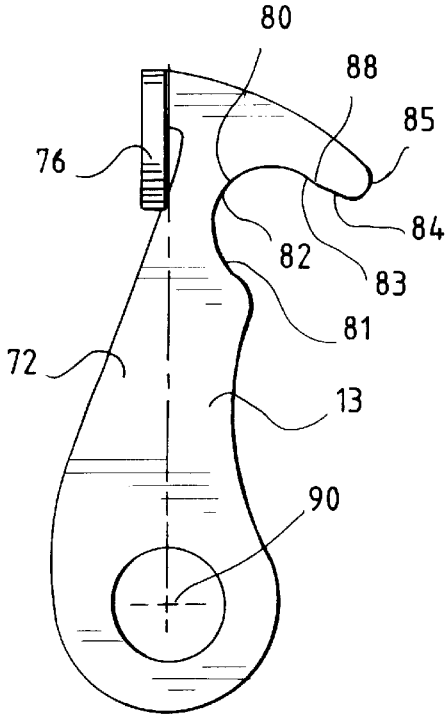
FIG. 5 is a plan view of an alternate embodiment of the swing arm of the ganging bracket of FIG. 1.

FIG. 5 is a plan view of an alternate embodiment of the swing arm of the ganging bracket of FIG. 1. The swing arm 72 comprises a seat 80, a tooth 88 located adjacent the seat 80, a hole 90 located distal the seat 80, and a tab 76 attached substantially perpendicular to the swing arm 72. FIG. 5 also shows arcs 81 through 85 disposed on the swing arm 72. The arcs 81 through 85 are designed to provide proper performance of the ganging bracket 10 using swing arm 72. The arcs 81 through 85 may have the characteristics and dimensions identified in the following Table B or may have any other characteristics and dimensions necessary for proper operation of the ganging bracket 10.

TABLE B

| ARC | CENTER [Origin (0, 0) is centerline of hole 90] | RADIUS | START | END |
|---|---|---|---|---|
| 81 | .576, 2.026 | .344" | 166° | 231° |
| 82 | .550, 2.053 | .313" | 43° | 170° |
| 83 | .813, 2.298 | .047" | 223° | 251° |
| 84 | 0, 0 | 2.391" | 67° | 71° |
| 85 | .985, 2.281 | .094" | 247° | 46° |

Figure 6:
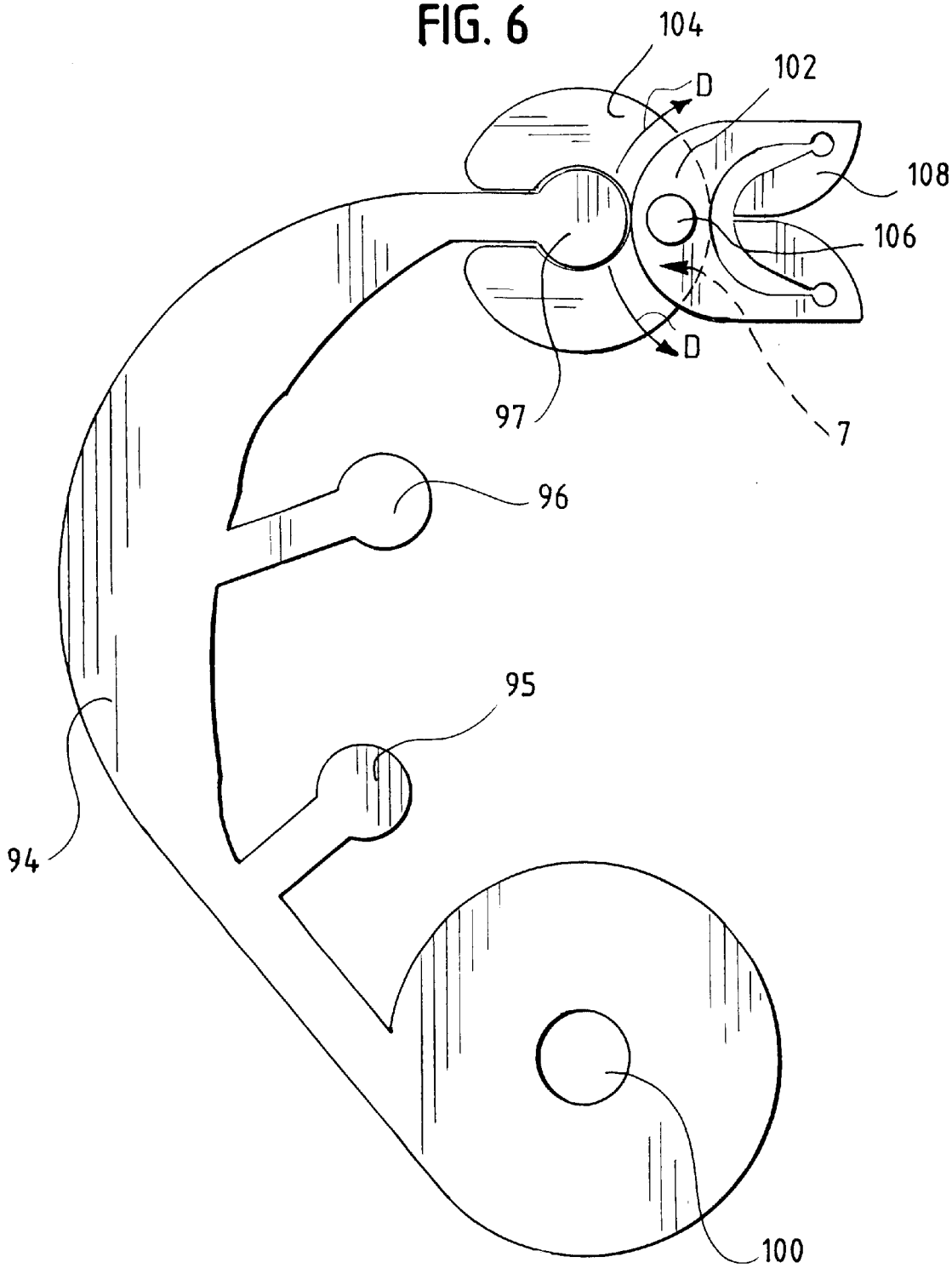
FIG. 6 is a plan view of another alternate embodiment of the swing arm of the ganging bracket of FIG. 1 engaging a receiving member.

FIG. 6 is another alternate embodiment of the swing arm of the present invention shown engaging a receiving member. The swing arm 94 comprises at least one connecting member 95, 96, 97 disposed on the swing arm distal a hole 100. It is noted that the swing arm 94 may have any number of connecting members 95, 96, 97 required for proper operation of the ganging bracket 10. The connecting members 95, 96, 97 may be configured to fit and removably lock into a receiving member 104. Receiving member 104 may be part of a connector assembly 102 that further comprises a pivotable connector 106 and a mounting member 108. Further, receiving member 104 may be constructed of rubber or any other elastomeric material.

Mounting member 108 may be secured to the underside of a first table by, for example, at least one screw and at least one washer or other connector. Pivotable connector 106 may pivotably connect the receiving member 104 to the mounting member 108. Receiving member 104 may pivot about pivotable connector 106 and mounting member 108 in the direction of arrows D as shown in FIG. 6. Hole 100 may receive mounting assembly 49 (not shown in FIG. 6) and mounting assembly 49 may pivotably connect the swing arm 94 to a second table.

As shown in FIG. 4, in use the table edges 12 and the centerlines of grommets 53 and 63 are aligned. The user then grasps tab 17 and pushes (or pulls) tab 17 (in the direction of Arrow A) so that swing arm 13 rotates (in the direction of Arrow B) around screw 50 and spacer 55 and toward grommet 63. The tooth 36, 37 or 38 (depending on the thickness of edges 12) then starts to press into the rubber grommet 63 and begins to pull the tables together. Next, the tooth 36, 37 or 38 depresses (see deflection at 70), rolls over and rotates (in the direction of Arrow C) rubber grommet 63. Then, the grommet 63 compressively fits into seat 19, 20, or 21 (depending on the thickness of edges 12) whereby the tooth 36, 37 or 38 is locked in place by the depressed rubber grommet 63 which may also be pressing into and locked against the seat 19, 20 or 21 thereby forming a fit that tightly secures the tables together in the properly aligned position (see FIG. 1). To unlock the seat 19, 20 or 21 from the grommet 63, the user pulls (or pushes) tab 17 (in the opposite direction of arrow A) away from grommet 63. The swing arm 13 may rotate completely about screw 50 and spacer 55 until the swing arm 13 is completely underneath the table. Typically, two ganging brackets 10 will be used to connect two tables together. In this situation, one ganging bracket 10 would be located at one end of the table core edge margin and the other ganging bracket 10 would be located at the opposite end of the table core edge margin. The first ganging bracket 10 may be mounted to the first table core 11 and the second ganging bracket 10 may be mounted to the first table core 11. With this specific mounting arrangement, the connector assemblies 59 would each be mounted on the second table core 11 opposite the corresponding ganging bracket 10. In another mounting arrangement, one ganging bracket 10 may be mounted on the first table core 11 while one ganging bracket 10 may be mounted on the second table core 11. Therefore, this mounting arrangement would necessitate that one connector assembly 59 would be mounted on the first table core 11 and one connector assembly 59 would be mounted on the second table core 11. However, any number of ganging brackets 10 may be used to connect two tables together.

It is also noted that the swing arms 13, 72 and 94 are a one-piece structure and can be easily and efficiently made by conventional, inexpensive bending and shaping manufacturing processes followed or preceded by a punching operation to form the openings. The swing arms 13 and 72 can also be manufactured by a computer controlled laser cutting and shaping system.

Although in the foregoing detailed description, the present invention has been described by reference to various embodiments, it will be understood that modifications in the structure and arrangement of those embodiments other than those specifically set forth herein may be achieved by those skilled in the art and that such modifications are to be considered as being within the overall scope of the present invention.

I claim:

1. A ganging bracket that is capable of connecting and locking together two tables, said bracket comprising:

a mounting assembly that can be attached to the first table;

a connector assembly that can be attached to the second table; and a substantially planar swing arm having a plurality of seats disposed on the swing arm and a tooth disposed on the swing arm proximate each seat constructed to engage and lock to the connector assembly and wherein the swing arm has an aperture that is disposed on the swing arm distal the plurality of seats, is constructed to receive the mounting assembly and is positioned and configured to allow the swing arm to be rotatably mounted to the first table.

2. The ganging bracket of claim 1 further comprising a tooth disposed on the swing arm proximate each seat.

3. The ganging bracket of claim 1 wherein the swing arm has substantially the same characteristics found in the following table:

| ARC | CENTER [Origin (0, 0) is centerline of hole 40] | RADIUS | START | END |
|---|---|---|---|---|
| 22 | −.925, 1.285 | .344" | 224° | 286° |
| 23 | −.948, 1.268 | .315" | 94° | 225° |
| 24 | −.975, 1.629 | .047" | 274° | 301° |
| 25 | 0, 0 | 1.851" | 111° | 121° |
| 26 | −.692, 1.818 | .094" | 291° | 345° |
| 27 | −.296, 1.715 | .315" | 67° | 165° |
| 28 | −.157, 2.049 | .047" | 247° | 274° |
| 29 | 0, 0 | 2.008" | 91° | 94° |
| 30 | −.031, 2.102 | .094" | 271° | 0° |
| 31 | .378, 2.100 | .315" | 48° | 180° |
| 32 | .620, 2.369 | .047" | 228° | 255° |
| 33 | 0, 0 | 2.402" | 72° | 75° |
| 34 | .787, 2.369 | .094" | 252° | 36°. |

4. The ganging bracket of claim 1 wherein the mounting assembly comprises at least one screw, at least one washer that can receive the at least one screw, at least one spacer that can receive the at least one screw, at least one grommet that can receive the at least one screw and at least one insert that can receive the at least one screw.

5. The ganging bracket of claim 4 wherein the at least one spacer is disposed inside the at least one grommet and is long enough to extend past both ends of the at least one grommet.

6. The ganging bracket of claim 4 wherein the screw further comprises a means for locking the screw into the insert.

7. The ganging bracket of claim 4 wherein at least one grommet has a groove adapted to fit inside of the aperture.

8. The ganging bracket of claim 4 wherein at least a surface portion of at least one grommet is constructed of an elastomeric material.

9. The ganging bracket of claim 1 wherein the connector assembly comprises at least one screw, at least one washer that can receive the at least one screw, at least one spacer that can receive the at least one screw, at least one grommet that can receive the at least one screw and at least one insert that can receive the at least one screw.

10. The ganging bracket of claim 9 wherein the at least one spacer is disposed inside the at least one grommet and is long enough to extend past both ends of the at least one grommet.

11. The ganging bracket of claim 9 wherein the screw further comprises a means for locking the screw into the insert.

12. The ganging bracket of claim 9 wherein at least one grommet has a groove adapted to receive at least one seat.

13. The ganging bracket of claim 9 wherein at least a surface portion of at least one grommet is constructed of an elastomeric material.

14. The ganging bracket of claim 1 further comprising a tab disposed on the swing arm proximate at least one seat.

15. A ganging bracket that is capable of connecting and locking together two tables, said bracket comprising:

a mounting assembly that can be attached to the first table;

a connector assembly that can be attached to the second table;

a swing arm having one seat disposed on the swing arm and constructed to engage and lock to the connector assembly whereby the portion of the connector assembly engaged by the seat is not fully positioned within the seat when the seat is locked to the connector assembly and wherein the swing arm is planar and has an aperture that is disposed on the swing arm distal the seat, is constructed to receive the mounting assembly and is positioned and configured to allow the swing arm to be rotatably mounted on the first table; and wherein the swing arm has substantially the same characteristics found in the following table:

| ARC | CENTER [Origin (0,0) is centerline of hole 90] | RADIUS | START | END |
|---|---|---|---|---|
| 81 | .576, 2.026 | .344" | 166° | 231° |
| 82 | .550, 2.053 | .313" | 43° | 170° |
| 83 | .813, 2.298 | .047" | 223° | 251° |
| 84 | 0, 0 | 2.391" | 67° | 71° |
| 85 | .985, 2.281 | .094" | 247° | 46°. |

* * * * *